US009351344B2

(12) United States Patent
Kano

(10) Patent No.: US 9,351,344 B2
(45) Date of Patent: May 24, 2016

(54) CERAMIC HEATER

(71) Applicant: SHIN-ETSU CHEMICAL CO., LTD., Tokyo (JP)

(72) Inventor: Shoji Kano, Annaka (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 227 days.

(21) Appl. No.: 14/161,725

(22) Filed: Jan. 23, 2014

(65) Prior Publication Data

US 2014/0263281 A1 Sep. 18, 2014

(30) Foreign Application Priority Data

Mar. 13, 2013 (JP) ..... 2013-049862
Dec. 16, 2013 (JP) ..... 2013-258853

(51) Int. Cl.

| | |
|---|---|
| ***H05B 3/08*** | (2006.01) |
| ***H05B 3/03*** | (2006.01) |
| ***H05B 3/28*** | (2006.01) |
| ***H05B 3/06*** | (2006.01) |

(52) U.S. Cl.
CPC .. *H05B 3/03* (2013.01); *H05B 3/06* (2013.01); *H05B 3/283* (2013.01)

(58) Field of Classification Search
CPC ..... H05B 3/03; H05B 3/06; H05B 3/283
See application file for complete search history.

(56) References Cited

U.S. PATENT DOCUMENTS

2008/0016684 A1* 1/2008 Olechnowicz .... H01L 21/67103 29/748

FOREIGN PATENT DOCUMENTS

JP 2702609 * 1/1998
JP 2702609 B2 1/1998

* cited by examiner

*Primary Examiner* — Shawntina Fuqua
(74) *Attorney, Agent, or Firm* — Westerman, Hattori, Daniels & Adrian, LLP

(57) ABSTRACT

A ceramic heater is proposed in which in the vicinities of the heating element's terminals where a bolt and a washer are used to fix and effect the electric supply connection to the heating element, the cover layer which covers most of the heating element is flush with an immediately neighboring part of the heating element layer so that the cover layer is not stepped at its edge and thus the washer does not scratch or otherwise damage the cover layer; a preferred embodiment adopts an electrically conductive protective film which is laid on this flush plane covering an area extending from the bolt hole to substantially beyond the line where the cover layer meets with the heating element layer.

19 Claims, 5 Drawing Sheets

CERAMIC HEATER

The present non-provisional patent application claims priority, as per Paris Convention, from Japanese Patent Application No. 2013-049862 filed on Mar. 13, 2013 and from Japanese Patent Application No. 2013-0258853 filed on Dec. 16, 2013, the disclosures of which are hereby incorporated by reference herein in entirety.

FIELD OF THE INVENTION

The present invention relates to a long-life ceramic heater with a high corrosion resistivity useful in heating wafers in processes for manufacturing semiconductor devices, optical devices, etc., in raw material heating processes, in heating for single crystal growth or manufacturing solar cells, and in heating to molten glass or to effect annealing.

BACKGROUND TECHNOLOGY

Conventionally, an electrical resistance heater used in a semiconductor process or an optical process has been of a type composed of a support base made of a sintered ceramic such as alumina, aluminum nitride, zirconia, boron nitride or the like, to which a wire or a foil of a high melting point metal such as molybdenum and tungsten is attached by winding or via adhesive as the heating element, with an electrically insulating ceramic plate mounted thereon, or of a type which is made by embedding the heating element directly in a support base and sintering them together at once. Further, there has been developed an improved electrical resistance ceramic heater in which a heating element layer made of a conductive ceramic is provided over an electrically insulating ceramic support base and the whole system is covered up with an electrically insulating ceramic cover layer, with the result that the electric non-conductance and corrosion resistivity are improved.

The ceramic support base is usually made of a sintered material obtained by sintering a raw powder after an addition of a sintering additive; however, since a sintering additive is added there are concerns that impurities may cause pollution at the time of heating and the corrosion resistivity is decreased. Also, since the support base is of a sintered material it carries a problem in terms of thermal shock resistance, and especially when the size is relatively large the sintering would proceed less uniformly with a result that the sintered body may carry a tendency to incur cracking or the like, so that such a body cannot be useful in a process where a rapid temperature rising or falling is inevitable.

To remedy this, a one-body type electrical resistance heater made of multi-layered ceramic has been developed, which consists of the support base made of pyrolytic boron nitride (hereinafter referred to simply as "PBN") formed by means of a thermo-chemical vapor phase vapor deposition method (hereinafter also called "thermo-CVD method"), the heating element made of pyrolytic graphite (hereinafter referred to as "PG") laid over the surface of the support base by means of thermo-CVD, and the densely laminated protective cover layer, made of the same material as the support base, laid over the heating element to cover up the entire heater, also by means of thermo-CVD method.

This kind of multi-layered ceramic heater is widely used as a high purity heater having characteristics of chemical stability and thermal shock resistance in various fields where a rapid temperature rising or falling is conducted, especially in the continuous process or the like wherein semiconductor wafers or the like are treated in one-by-one manner with the temperature controlled step-wise respectively. Also, as all of the constituting layers of this multi-layered ceramic heater are made by means of thermo-CVD method, there exists no grain boundary in it that is found in a sintered ceramic heater made by sintering powder so that the tissue is dense and does not absorb gas whereby no outgas occurs with a consequence that it has increased its popularity as a heater that does not affect the degree of vacuum in an evacuated process.

Also, normally in this kind of a ceramic heater, for the purpose of conducting electricity to the heating element, a hole must be made through an end portion which functions as a terminal and also a part of the heating element constituting the electric passage must be exposed by removing a part of the electrically insulating protective cover layer, which covers the heating element. The current practice is to use a bolt and a washer at the terminal locations to secure electricity passage. When this procedure of fixing by bolt and washer is adopted to effect electric conductance, the screwing up of the bolt may cause the washer to turn slightly, and this may in turn damage the edge of the insulating ceramic protective cover layer in the vicinity and may cause abnormal heating on account of the consequent poor electric contact, whereby the temperature distribution is ill-affected and, without remedying, the exposed part of the terminal can wear out and begins sparking and in the end the circuit may be snapped at the terminal portion.

In this regard, IP Publication 1 discloses a PBN heating apparatus wherein, in order to prevent the above-mentioned problem, a terminal post, which is formed with a female screw so as to threadably receive a bolt, is fixed at a terminal position of a heating element whereby the heater body and the terminal post are made in one body and this one body is coated with an insulating cover layer. However, even with this kind of PBN heating element, a contact failure occurs between the terminal post and the terminal of the heating element after thermal hysteresis giving rise to an abnormal heating and snapping of the circuit, so that still a connection method that can perfectly prevent the above-mentioned trouble is hoped for.

LIST OF PRIOR ART PUBLICATIONS

IP Publications

[IP Publication 1] Japanese Patent No. 2702609

BRIEF DESCRIPTION OF THE INVENTION

Problems the Invention Seeks to Solve

It is therefore an object of the present invention, in view of the above-mentioned circumstances, to provide a long-life ceramic heater with a high corrosion resistivity useful as a heating means in manufacturing single crystal etc., which is capable of preventing a washer from causing damages that may happen when the heating body is being connected to the electricity supply member.

The present inventor discovered that a foreign matter or a contaminant is generated as the protective cover layer is cracked when the washer or a headed bolt being turned collides with the edge of the protective cover layer during the work of connecting the electricity supply member to the heater terminal for the reason that there is a step between the exposed face 11 of the electrically conductive member (heating element) and the electrically insulating ceramic protective cover layer 10 surrounding the former (ref. FIG. 1). Such foreign matter and the contaminant, on one hand, contaminate, for example, a semiconductor wafer being heat-treated, and, on the other hand, become a cause for poor connection at the electricity supply terminal, which in turn gives rise to a problem of abnormal heating and sparking triggered by circuit snapping with a result that the life of the heater is shortened, and thus the inventor thought that if the structure of the heater terminal is improved, troubles like this could be avoided, and hence came to possess the present invention.

Means to Solve the Problem

Hence, according to the present invention, a ceramic heater includes a support base made of an electrically insulating ceramic material, a heating element pattern made of an electrically conductive material laid over the support base, and a cover layer made of an electrically insulating ceramic material laid over the heating element pattern, and this ceramic heater has a through hole at each of its electricity supply terminals for fixing terminal devices such as bolts, and in this ceramic heater in the vicinities of the terminals the upper face of the cover layer meets with the exposed upper face of an electrically conductive layer to form a flush plane face.

In an alternative embodiment of the present invention, that portion of the electrically conductive layer which is immediately neighboring the through hole is replaced by an electrically insulating ceramic body preferably made of the same material as the cover layer. By virtue of this electrically insulating ceramic body, the corrosive gas that has leaked along the threads of the bolt does not reach and erode the electrically conductive layer.

The electrically conductive layer of the present invention is preferably made of the same material as the above-mentioned electrically conductive member (heating element pattern) is made of. In particular, it is possible that the electrically conductive layer consists of a part of the electrically conductive member, i.e., the heating element pattern, or of an electrically conductive ring-like flat body which is laid around the through hole. The electrically conductive layer is embodied as an embossment (plateau) in a shape of a circular truncated cone or a circular column with a bore in the middle. In the case in which the embossment consists of a part of the electrically conductive layer this embossment may be formed by virtue of that the support base has a raised part in the vicinities of the terminal in a shape of a circular truncated cone with a bore in the middle. In the case in which the embossment consists of a layer of the electrically conductive ring-like flat body, the flat body itself constitutes the embossment. It is possible to lay this electrically conductive ring-like flat body on an area of the support base or the electrically conductive member where the electrically conductive layer is desired to be formed, and in each of these cases it is possible that the support base is pre-machined to have an embossment in the above-mentioned area.

In the present invention, it is preferable that a corrosion resistant electrically conductive protective film is provided on the said flush plane over an area extending from the through hole to well beyond the exposed upper face of the electrically conductive layer to thereby cover up the exposed upper face of the electrically conductive layer. Preferable examples of materials to make the electrically conductive protective layer which has a corrosion resistance to the kind of atmospheres used in the field of the present invention include tungsten, tantalum, silicon, platinum, nickel, molybdenum silicide, and silicon carbide. Preferable examples of ceramic materials to make the support base and the insulating ceramic layer of the present invention include alumina ($Al_2O_3$), aluminum nitride (AlN), boron nitride (BN), a complex of AlN and BN, pyrolytic boron nitride (PBN), graphite coated with pyrolytic boron nitride, and quartz.

Effect of the Present Invention

In the ceramic heater of the present invention, a step between the exposed upper face of an electrically conductive layer and the surrounding insulating ceramic protective cover layer is eliminated and thus the edge of the cover layer does not form a step, so that the washer or the like will no longer tend to damage the protective cover layer or the like when the electricity supply member is fixed, with a result that there is no possibility of contamination by dust or contaminant that would have occurred by such damaging of the elements, and also with a result that when the heater is used in a corrosive atmosphere, the exposed face of the electrically conductive heating element is free of being damaged by the ambient gas so that the heater can be used for a long duration of time stably.

EXAMPLES TO EMBODY THE PRESENT INVENTION

Figure 1:
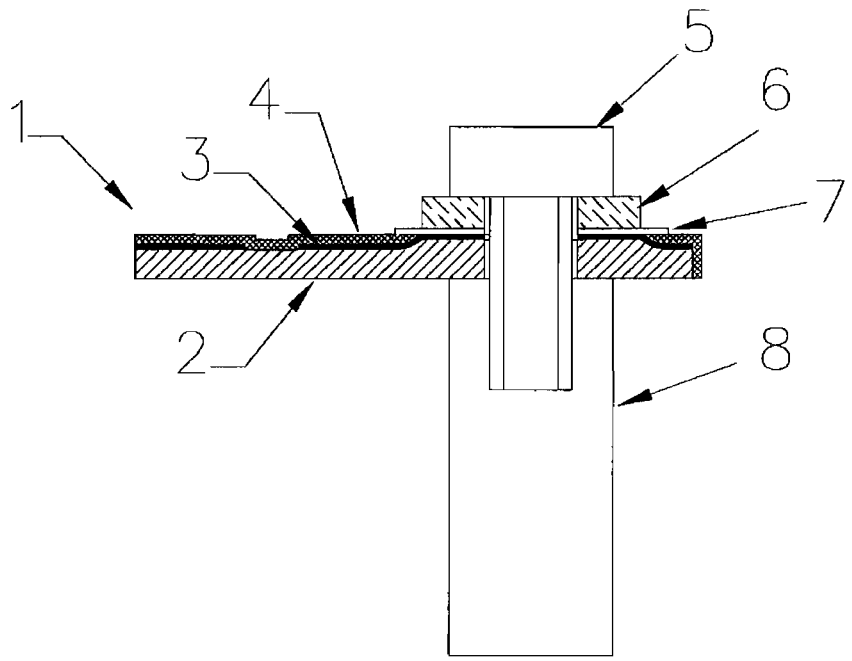
FIG. 1 is a schematic cross section of members in the vicinity of a terminal in the case of Example 1 of the ceramic heater of the present invention.

We will now explain examples of the ceramic heater 1 of the present invention in concrete terms, but the scope of the present invention shall not be construed limited by these examples.

An important feature of the present invention lies in that, in the terminal area of the ceramic heater 1, the exposed upper face 11 of the electrically conductive layer is flush with the upper face of the cover layer 4, and, by virtue of adopting this manner of terminal structure, there is created no step between the exposed upper face 11 of the electrically conductive layer and the surrounding insulating ceramic cover layer 4 and thus edge of the cover layer 4 does not form a step. On account of this, it is possible to prevent the electricity supply terminal members such as the washer 6 and the headed bolt 5 from colliding with and damaging the edge of the surrounding insulating ceramic cover layer 4, which happens if a conventional terminal structure is adopted, so that (i) abnormal heating caused by poor electrical connection triggered by a foreign matter or a contaminant coming from the damaging collision or (ii) sparking caused by wearing of the exposed part of the terminal, are avoided, and hence the life of the heater is extended. In the present invention, the upper face of the cover layer 4 is flush with the exposed upper face 11 of the electrically conductive layer, and they form a gapless plane. To make the upper face of the cover layer 4 flush with the exposed face 11 of the electrically conductive layer, it is possible to subject the cover layer 4 to machine grinding. In this operation it is preferable to attain the flushness through a range of no less than 0.5 mm from the line at which the cover layer meets with the electrically conductive layer, because if the range is less than 0.5 mm, there is a possibility that the washer 6 scratches the surface of the cover layer 4.

Figure 2:
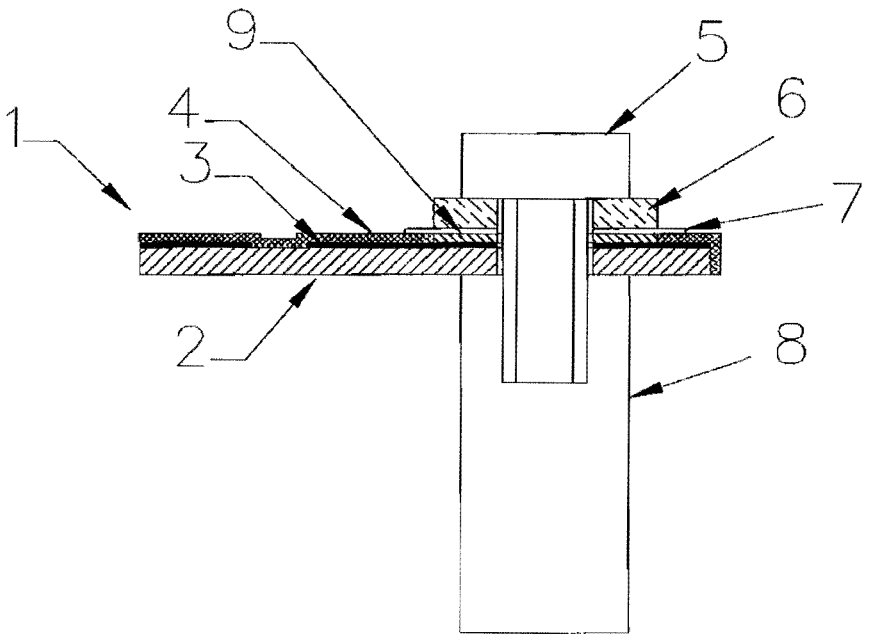
FIG. 2 is a schematic cross section of members in the vicinity of a terminal in the case of Example 2 of the ceramic heater of the present invention.
Figure 5:
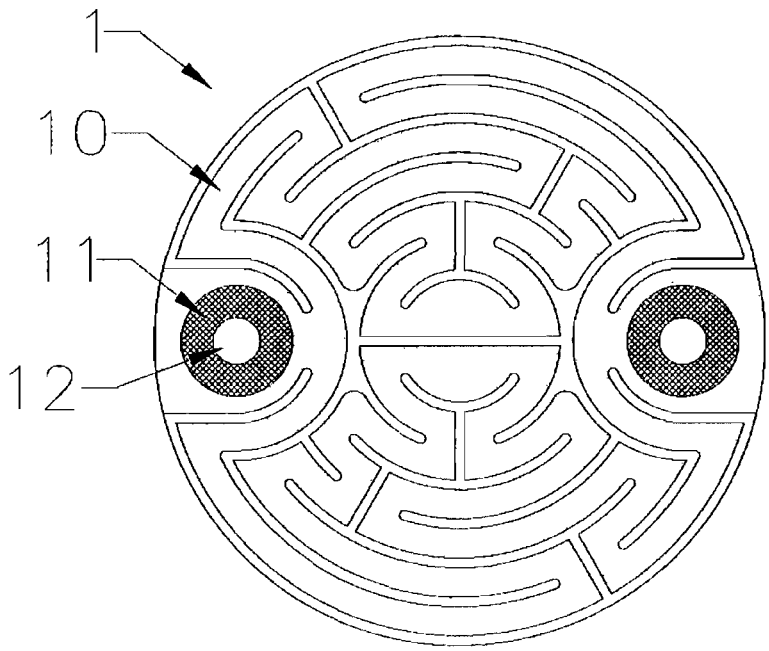
FIG. 5 is a schematic view showing a heating element pattern and terminals in the case of a ceramic heater of the present invention.

Now, the electrically conductive layer of the present invention is a layer having a substantial thickness and made of a material having an electrical conductivity; in particular, it can be a part of the electrically conductive member 3, which constitutes the heater pattern, as shown in FIG. 1, or it can be the electrically conductive flat body 9, as shown in FIG. 2, which is laid to occupy the area indicated by 11 in FIG. 5, to provide the exposed face 11 to the heater terminal. In cases of other embodiments in which the electrically conductive layer is formed in the area 11 in different manners, such embodiments are also within the scope of the present invention.

As a method for making the exposed face 11 of the electrically conductive layer flush with the upper face of the cover layer 4, it is preferable to embody the electrically conductive layer as an embossment. In the case in which the embossment consists of a part of the electrically conductive member 3, this embossment may be formed by first preparing the support base 2 to have a raised part in the area coinciding with the area 11 of FIG. 5, and then laying the electrically conductive member 3 over the support base 2. In particular, as shown in FIG. 1, it is preferable to form the embossment with a slanted side wall so that the embossment has a shape of a truncated circular corn, and the slanted side wall can have a profile of an arc. In the case of an arched profile, it is possible to make the embossment economically for there is no need to add a complexly shaped stage since it is possible to make and finish a continuous and highly smooth side wall face to the embossment by means of a turn machine with an end mill tool.

As an alternative manner of forming the embossment, it is possible, as shown in FIG. 2, to lay an electrically conductive flat ring-like body 9, made of the same or not the same material as the heating element, over the area coinciding with the area 11 of the heater terminal in a manner such that the upper face of this electrically conductive flat body 9 becomes flush with the upper face of the cover layer 4. In a further alternative, it is also possible to first lay this electrically conductive flat body 9 over the support base 2 and thereafter to deposit the electrically conductive member 3 over the electrically conductive flat body 9 as well as the support base 2 to create the electrically conductive layer to be flush with the cover layer 4.

Incidentally, in the embodiment of FIG. 2, the support base 2 at the terminal is not raised, but even in this kind of embodiment it is possible to form a truncated conical embossment to the support base 2 and then lay the electrically conductive member 3 and flat body 9 over the embossment, in which case the flat body 9 constitutes the electrically conductive layer of the present invention.

Figure 3:
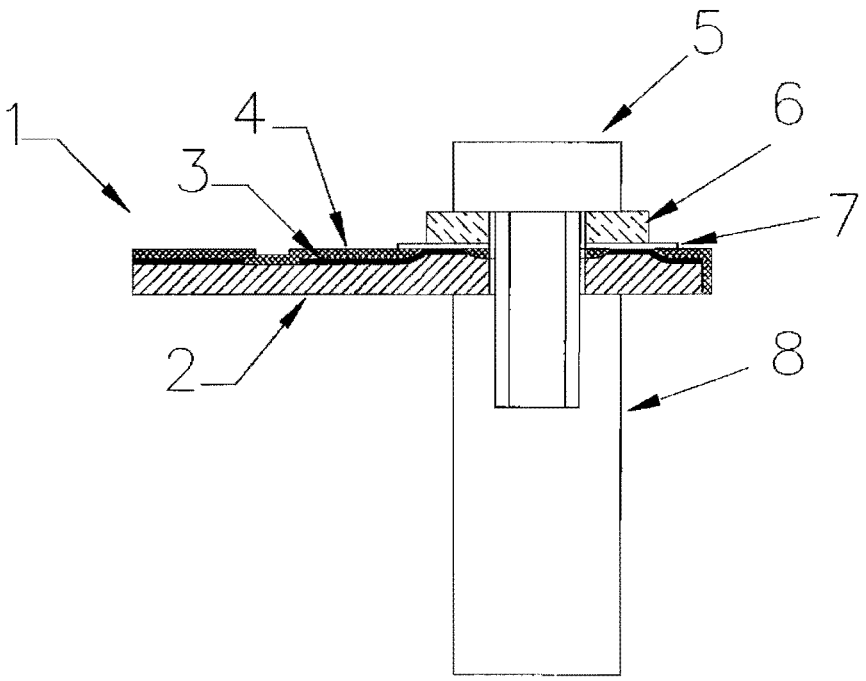
FIG. 3 is a schematic cross section of members in the vicinity of a terminal in the case of Example 3 of the ceramic heater of the present invention.

FIG. 3 shows another embodiment wherein, in the immediate vicinity of the through hole 12 for threadably fixing the terminal headed bolt 5, a portion of the embossed part of the electrically conductive member 3 is replaced by the cover layer 4 made of an electrically insulating ceramic in a manner such that the upper face of the cover layer 4 is flush with the exposed face 11 of the heater terminal. Since the cover layer 4 is additionally formed in the vicinity of the through hole 12, the exposed face 11 of the electrically conductive member 3 is not exposed to the headed bolt 5 so that the corrosive gas that has leaked along the threads of the bolt 5 does not reach and erode the electrically conductive member 3 with a result that the service life of the ceramic heater 1 is still further lengthened.

It is preferable that the support base 2 of the present invention is made of a material selected from a group consisting of alumina (Al2O3), aluminum nitride (AlN), boron nitride (BN), a complex of AlN and BN, pyrolytic boron nitride (PBN), graphite coated with pyrolytic boron nitride, and quartz. These materials are solid and heat resistant at high temperatures, which are requisite characteristics to the support base 2.

It is also preferable that the heater terminal and the heating element are made of a high melting point metal like tungsten, tantalum and molybdenum or of another known material that is suitable to make a heater such as pyrolytic graphite, silicon carbide, and molybdenum silicide. The electrically conductive member 3 made as such is formed over the support base 2 by means of spattering method, chemical vapor deposition method, ion plating method, printing method, plating method, etc., and after its formation it is subjected to a heat treatment to an extent depending on the requirement.

The cover layer 4 made of an electrically insulating ceramic of the present invention is preferably made of the same material of which the support base 2 is made, whereby it is possible to construct a ceramic heater which involves small difference in thermal expansion coefficient and thus is hard to undergo deformation. Such cover layer 4 may be formed by a simultaneous calcination together with the support base 2 or by spattering method, chemical vapor deposition method, ion plating method, printing method, or plating method, and after its formation it is subjected to a heat treatment to an extent depending on the requirement.

In the present invention, it is possible to bring the exposed face 11 of the terminal consisting of the electrically conductive layer flush with the upper face of the cover layer 4 in the manners as enumerated above, but it is preferable that a corrosion resistant electrically conductive protective film 7 is thereafter provided to cover the exposed face 11 of the electrically conductive layer and some of the surrounding part of the cover layer 4 to protect them against the ambient atmosphere in use. It is possible to protect the exposed terminal face 11 of the electrically conductive layer against the ambient atmosphere consisting of a corrosive gas, etc. by means of the electrically conductive protective film 7, so that the service life of the ceramic heater is still further lengthened. The material of which the electrically conductive protective film 7 is made is preferably selected from tungsten, tantalum, silicon, platinum, nickel, molybdenum silicide, and silicon carbide, because these materials can be used with better stability in an atmosphere including a highly corrosive gas such as fluorine-containing gas, ammonium gas, hydrogen gas, hydrogen chloride gas, and oxygen. The electrically conductive protective film 7 of the present invention can be laid by means of spattering method, CVD method, ion plating method, printing method, or plating method; it is also possible to lay the electrically conductive protective film 7 by adhesion.

Also, in the present invention, it is preferable that the diameter of the washer 6 and that of the head of the headed bolt 5 are larger than the diameter of the exposed electrically conductive layer. When a washer 6 or a headed bolt 5 having a diameter larger than that of the exposed face of the electrically conductive layer is used, the exposed face 11 of the electrically conductive layer is prevented from being directly exposed to the highly corrosive gas at the terminal so that the service life can be further lengthened. Now, the washer 6 may be made of any material so long as it has electrical conductivity; however, preferably, a material having a high malleability such as graphite sheet and platinum is used, for the sealing at the terminal location is improved and thus the permeation of the corrosive gas is suppressed.

EMBODIMENT

We will now explain concrete examples of the present invention.

Example 1

First in order to make a support base 2 of pyrolytic boron nitride (PBN) of the present invention, ammonia (NH3) was reacted with boron trichloride (BCl3) under a pressure of 100 Torr at 1900 degrees C. in the manner of CVD method and the product was machined to form a body of 50 mm in outer diameter and 2 mm in thickness. Then, as shown in FIG. 1, this support base 2 was machined to have two truncated conical embossments, one for each electrically conductive terminal, in a manner such that the embossment had a height of 0.15 mm and that the upper face of the embossment had a diameter of 8 mm, which was to be roughly the same as the outer diameter of the later formed exposed face of the electrically conductive member 3, and thus the support base 2 was finished.

Next, in order to form a heating layer and terminals of the electrically conductive member 3 of the ceramic heater 1, methane was thermally decomposed at 5 Torr and 1750 degrees C., and a 50 micrometer thick pyrolytic graphite layer as the electrically conductive member 3 was formed on the support base 2, and it was machined to obtain a heating element pattern 10 of the ceramic heater 1, as shown in FIG. 5; and a cover layer 4 of pyrolytic boron nitride having a thickness of 0.15 mm was formed all over the heating element pattern 10 under the same conditions as in the case of forming the support base 2

A through hole 12 having a diameter of 3.4 mm was made at each one of two terminals of the ceramic heater 1, and the cover layer 4 was removed by machining from the surroundings of the through holes 12, and thus, as shown in FIG. 1, the electrically conductive member 3 was exposed in a manner such that the exposed face 11 for connection to a power source becomes flush with the upper face of the cover layer 4. Then, the electrically conductive protective film 7 of tungsten having an outer diameter of 12 mm, which has corrosion resistance against the ambient atmosphere to be used, is formed by ion plating method so as to cover whole of the two electrically conductive terminal exposed faces 11 as well as the narrow parts of the cover layer 4 of the electrically insulating ceramic that surround the respective exposed faces 11, and hence the ceramic heater 1 of FIG. 1 was completed.

The thus completed ceramic heater 1 was brought in a vacuum chamber, and it was connected to terminal posts 8 of the heater apparatus via a platinum washer 6 having the same outer diameter as the electrically conductive terminal exposed face 11; then as the air was drawn from the vacuum chamber the temperature was raised to 1300 degrees C.; after this, ammonia was supplied into the chamber at a flow rate of 100 ml per minute and at the same time the intra-chamber pressure was adjusted to 5000 Pa. The vacuum chamber was maintained under this condition with the temperature of the ceramic heater 1 unchanged at 1300 degrees C., and after one hundred hours had passed the electricity supply was discontinued and the heater was cooled.

After the cooling, the ceramic heater 1 was retrieved from the chamber and the terminals of the heater 1 were observed, and it was found that the protective layers 7 of tungsten were wholly existing at the heater terminals and that there was no appearance of consumption in the electrically conductive exposed faces 11 of the terminals. Also, there was no abnormal heating during the experiment, and no spark-related trouble was observed either.

Example 2

In Example 2, the same CVD method as in Example 1 was employed to manufacture a PBN support base 2 having a dimension of 50 mm in outer diameter and 2 mm in thickness. Also, employing the same method as in Example 1, a heating layer and terminals of the electrically conductive member 3 of the ceramic heater 1, and also a heating element pattern 10 of the ceramic heater were made, as shown in FIG. 5; then, a cover layer 4 of pyrolytic boron nitride having a thickness of 0.15 mm was formed all over them.

Next, in Example 2, a 3.4-mm-diameter through hole 12 was made in each of the two terminals of the ceramic heater 1, and a part of the cover layer 4, which coincides with a ring area having an outer diameter of 8 mm and surrounding the through hole 12 was removed by machining, and thus the electrically conductive member 3 was exposed there and, as shown in FIG. 2, an electrically conductive ring-like flat body 9 was laid on this currently exposed area of the electrically conductive member 3 in a manner such that the upper face of this electrically conductive flat body 9 was flush with the upper face of the cover layer 4, and thus the heater terminal was prepared.

In the subsequent steps, employing the same manners as in Example 1, an electrically conductive protective film 7 of tungsten having an outer diameter of 12 mm, which has a corrosion resistance against the ambient atmosphere to be used, was formed by ion plating method, and hence the ceramic heater 1 of FIG. 2 was completed.

The thus completed ceramic heater 1 was connected to terminal posts 8 of the heater apparatus via a platinum washer 6 having the same outer diameter as the electrically conductive terminal exposed face 11. Then adopting the same conditions as in Example 1, the ceramic heater 1 was maintained at a temperature of 1300 degrees C. for one hundred hours; thereafter, the electricity supply was stopped and the heater was cooled.

After the cooling, the ceramic heater 1 was retrieved from the chamber and the terminals of the heater 1 were observed, and it was found that, also in this Example 2, the protective films 7 of tungsten were wholly existing at the heater terminals and that there was no appearance of consumption in the electrically conductive exposed faces 11 of the terminals. Also, there was no abnormal heating during the experiment, and no spark-related trouble was observed either.

Example 3

In Example 3, the same CVD method as in Example 1 was employed to manufacture a PBN support base 2 having a dimension of 50 mm in outer diameter and 2 mm in thickness. Also, employing the same method as in Example 1, this support base 2 was machined to have two truncated conical embossments, one for each electrically conductive terminal, as shown in FIG. 3, in a manner such that the embossment had a height of 0.15 mm and that the upper face of the embossment had a diameter of 8 mm, which was to be roughly the same as the outer diameter of the later formed exposed face of the electrically conductive member 3, and thus the support base 2 was finished.

Then, employing the same method as in Example 1, a pyrolytic graphite (PG) layer of a thickness of 50 micrometers to constitute the electrically conductive member 3, was laid over the support base 2, and this member 3 was machined to have a heating element pattern 10, as is shown in FIG. 5, of the ceramic heater 1. In this Example 3, at the time of machining out the heating element pattern 10, a part of the PG layer, that is, the electrically conductive member 3 was removed by machining from a one-millimeter-wide ring area immediately surrounding the later formed through hole 12 at each terminal, and thereafter a cover layer 4 of pyrolytic boron nitride having a thickness of 0.15 mm was formed all over this heating element pattern 10 using the same method as in the case of forming the support base 2.

Next, a 3.4-mm-diameter through hole 12 was made in each of the two terminals of the ceramic heater 1, and the cover layer 4 in an area surrounding the through holes 12 except for the above-mentioned one-millimeter-wide ring area was removed by machining, and thus the electrically conductive member 3 was exposed there in a manner such that the upper face of the cover layer 4 was flush with the currently exposed upper face of the electrically conductive member 3, and thus the electrically conductive terminal exposed face 11 for connection to a power source was formed. The thus prepared heater terminal structure is shown in FIG. 3.

In the subsequent steps, employing the same manners as in Example 1, an electrically conductive protective film 7 of tungsten having an outer diameter of 12 mm, which has a corrosion resistance against the ambient atmosphere to be used, was formed by ion plating method, and hence the ceramic heater 1 of FIG. 3 was completed.

The thus completed ceramic heater 1 was connected to terminal posts 8 of the heater apparatus via a platinum washer 6 having the same outer diameter as the electrically conductive terminal exposed face 11. Then adopting the same conditions as in Example 1, the ceramic heater 1 was maintained at a temperature of 1300 degrees C. for one hundred hours; thereafter, the electricity supply was stopped and the heater was cooled.

After the cooling, the ceramic heater 1 was retrieved from the chamber and the terminals of the heater 1 were observed, and it was found that, in this Example 3 too, the protective films 7 of tungsten were wholly existing at the heater terminals and that there was no appearance of consumption in the electrically conductive exposed faces 11 of the terminals. Also, there was no abnormal heating during the experiment, and no spark-related trouble was observed either. Especially in this Example 3 it is thought that the cover layer 4 occupying the above-mentioned one-millimeter-wide ring area immediately surrounding the through hole 12 worked to stop the highly corrosive gas from the through hole 12 so well that the electrically conductive terminal exposed face 11 was kept perfectly intact.

Comparative Example

Figure 4:
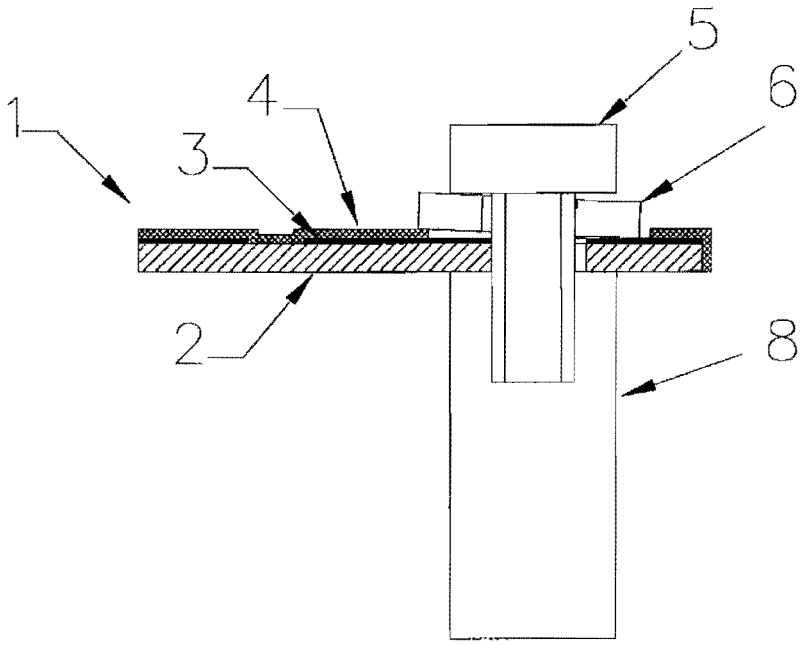
FIG. 4 is a schematic cross section of members in the vicinity of a terminal in the case of a conventional ceramic heater.

In Example 3, the same CVD method as in Example 1 was employed to manufacture a similar PBN support base 2, and also, employing the same procedure as in Example 2, except for not including the electrically conductive flat body 9 and the electrically conductive protective film 7, the terminal structure of the ceramic heater 1 including the electrically conductive member 3, the heating element pattern 10, and the pyrolytic boron nitride cover layer 4 was made. As shown in FIG. 4, the exposed face 11 of the electrically conductive member 3 is not flush with the upper face of the cover layer 4, and since the electrically conductive flat body 9 is lacking from the heater terminal, there is formed a step between the said exposed face 11 and the upper face of the cover layer 4, and hence the cover layer 4 has a stepped edge.

The thus completed ceramic heater 1 was connected to terminal posts 8 of the heater apparatus via a platinum washer 6, and then adopting the same conditions as in Example 1, the ceramic heater 1 was maintained at a temperature of 1300 degrees C. for one hundred hours; thereafter, the electricity supply was stopped and the heater was cooled.

After the cooling, the ceramic heater 1 was retrieved from the chamber and the terminals of the heater 1 were observed, and it was found that the washer 6 was dislocated and in its vicinities the electrically insulating cover layer 4 was partly broken. Also, there was an appearance showing that the electrically conductive exposed face 11 of the terminal was consumed to some extent.

REPRESENTATION OF REFERENCE NUMERALS

1: ceramic heater
2: support base
3: electrically conductive member
4: cover layer
5: bolt
6: washer
7: electrically conductive protective film
8: terminal post for electricity supply
9: electrically conductive flat body (to be attached)
10: heating element pattern
11: exposed face of heater terminal
12: through hole Scopes of what is claimed:

1. A ceramic heater comprising:

a support base made of an electrically insulating ceramic material, a heating element pattern made of an electrically conductive material laid over said support base, and a cover layer made of an electrically insulating ceramic material laid over said heating element pattern, wherein said ceramic heater has electricity supply terminals each having a through hole for fixing terminal devices and an exposed upper surface of an electrically conductive layer, and wherein in vicinities of said terminals an upper surface of said cover layer is flush with said exposed upper surface of said electrically conductive layer thereby forming a flat plane.

2. The ceramic heater as claimed in claim 1, wherein a portion immediately neighboring said through hole comprises an electrically insulating ceramic body.

3. The ceramic heater as claimed in claim 1, wherein said electrically conductive layer is made of a same material as said heating element pattern.

4. The ceramic heater as claimed in claim 1, wherein said electrically conductive layer is either a part of said heating element pattern or an electrically conductive flat means which is laid around said through hole.

5. The ceramic heater as claimed in claim 1, wherein said electrically conductive layer has a convex shape.

6. The ceramic heater as claimed in claim 5, wherein said said convex shape is formed as a raised part in a shape of a truncated circular cone of said support base.

7. The ceramic heater as claimed in claim 5, wherein said electrically conductive material is laid on an area of said support base or said electrically conductive heating element pattern at which area said electrically conductive layer is desired to be formed.

8. The ceramic heater as claimed in claim 1, wherein a corrosion resistant electrically conductive protective film is provided to lay over said flush plane covering an area extending from said through hole to substantially beyond the exposed upper surface of said electrically conductive layer.

9. The ceramic heater as claimed in claim 8, wherein said corrosion resistant electrically conductive protective film is made of a material selected from tungsten, tantalum, silicon, platinum, nickel, molybdenum silicide, and silicon carbide.

10. The ceramic heater as claimed in claim 1, wherein said support base and said cover layer are independently made of a material selected from alumina ($Al_2O_2$), aluminum nitride (AlN), boron nitride (BN), a complex of AlN and BN, pyrolytic boron nitride (PBN), graphite coated with pyrolytic boron nitride, and quartz.

11. The ceramic heater as claimed in claim 2, wherein said electrically conductive layer is made of a same material as said heating element pattern.

12. The ceramic heater as claimed in claim 2, wherein said electrically conductive layer is either a part of said heating element pattern or an electrically conductive flat means which is laid around said through hole.

13. The ceramic heater as claimed in claim 2, wherein said electrically conductive layer has a convex shape.

14. The ceramic heater as claimed in claim 6, wherein said electrically conductive material is laid on an area of said support base or said electrically conductive heating element pattern at which area said electrically conductive layer is desired to be formed.

15. The ceramic heater as claimed in claim 2, wherein a corrosion resistant electrically conductive protective film is provided to lay over said flush plane covering an area extending from said through hole to substantially beyond the exposed upper surface of said electrically conductive layer.

16. The ceramic heater as claimed in claim 6, wherein a corrosion resistant electrically conductive protective film is provided to lay over said flush plane covering an area extending from said through hole to substantially beyond the exposed upper surface of said electrically conductive layer.

17. The ceramic heater as claimed in claim 2, wherein said support base and said cover layer are independently made of a material selected from alumina ($Al_2O_2$), aluminum nitride (AlN), boron nitride (BN), a complex of AlN and BN, pyrolytic boron nitride (PBN), graphite coated with pyrolytic boron nitride, and quartz.

18. The ceramic heater as claimed in claim 6, wherein said support base and said cover layer are independently made of a material selected from alumina ($Al_2O_2$), aluminum nitride (AlN), boron nitride (BN), a complex of AlN and BN, pyrolytic boron nitride (PBN), graphite coated with pyrolytic boron nitride, and quartz.

19. The ceramic heater as claimed in claim 9, wherein said support base and said cover layer are independently made of a material selected from alumina ($Al_2O_2$), aluminum nitride (AlN), boron nitride (BN), a complex of AlN and BN, pyrolytic boron nitride (PBN), graphite coated with pyrolytic boron nitride, and quartz.

* * * * *